United States Patent [19]

Brooks

[11] 4,297,852

[45] Nov. 3, 1981

[54] REFRIGERATOR DEFROST CONTROL WITH CONTROL OF TIME INTERVAL BETWEEN DEFROST CYCLES

[75] Inventor: Robert B. Brooks, Louisville, Ky.

[73] Assignee: General Electric Company, Louisville, Ky.

[21] Appl. No.: 169,570

[22] Filed: Jul. 17, 1980

[51] Int. Cl.[3] ..... F25D 21/06

[52] U.S. Cl. ..... 62/153; 62/155

[58] Field of Search ..... 62/153, 154, 155, 156, 62/157, 158, 234

[56] References Cited

U.S. PATENT DOCUMENTS

| | | | |
|---|---|---|---|
| 2,463,027 | 3/1949 | Frie | 62/153 |
| 2,697,332 | 12/1954 | Duncan | 62/153 |
| 2,701,450 | 2/1955 | Duncan | 62/153 |
| 2,781,641 | 2/1957 | Foley | 62/153 |
| 3,460,352 | 8/1969 | Lorenz | 62/153 |
| 3,474,638 | 10/1969 | Dodge | 62/153 |
| 3,518,841 | 7/1970 | West, Jr. | 62/153 |
| 3,890,798 | 6/1975 | Fujimoto et al. | 62/155 |
| 4,056,948 | 11/1977 | Goodhouse | 62/155 |

FOREIGN PATENT DOCUMENTS

| | | | |
|---|---|---|---|
| 613819 | 1/1961 | Canada | 62/153 |

*Primary Examiner*—William E. Wayner
*Assistant Examiner*—Harry Tanner
*Attorney, Agent, or Firm*—Frederick P. Weidner; Radford M. Reams

[57] ABSTRACT

Door open time in an automatic defrost refrigerator is accumulated in the memory of a microcomputer. Normal cycling of defrost is delayed by inactivating the defrost timer during periods of light usage of the refrigerator until a minimum predetermined accumulated door open time is reached. Provision is made for sensing interior refrigerator temperature to override the delaying effect of the door open measurement when a sensed over-temperature condition indicates an abnormal build-up of frost on the evaporator coils even though the refrigerator is experiencing relatively light usage. A maximum compressor run time interval between defrost cycles is provided for when no door openings occur, as during vacation periods.

3 Claims, 3 Drawing Figures

REFRIGERATOR DEFROST CONTROL WITH CONTROL OF TIME INTERVAL BETWEEN DEFROST CYCLES

BACKGROUND OF THE INVENTION

1. Field of the Invention

This invention relates to a control for an automatic defrost refrigerator and in particular to an electronically controlled defrost system in which intervals between defrost cycles are varied as a function of minimum compressor run time and of refrigerator usage as measured by door open time.

2. Description of the Prior Art

It is well known in a frost-free refrigerator to control the time interval between defrost cycles by means of a motor operated electromechanical timer means coupled across the motor operated compressor of the refrigerant system. Thus, in this arrangement, the compressor and defrost timer run and shut off simultaneously under control of the refrigerator compartment thermostat until a preset interval of compressor run time is reached, e.g. 7½ hours, as determined by the timer. At this point, a switch on the timer removes the compressor motor and substitutes the defrost heaters. During the defrost cycle, typically thirty minutes, the timer continues to run until the defrost cycle is completed, at which point the timer switch reverts to the motor compressor circuit and the entire cycle as described above is repeated. U.S. Pat. No. 3,890,798 is representative of art teaching the use of a digital timer in place of the electromechanical timer to set the interval between defrost cycles as a function of compressor run time.

In U.S. Pat. No. 2,701,450, an electromechanical accumulator and door open sensor are shown for the purpose of providing demand defrost as a function of accumulated door open time. However, a variety of environmental conditions, as well as structural conditions of the refrigerator itself, can affect the timing of needed defrost cycles. This patent disclosure has no provision to take this into account except to provide for a manual override by which the user can accelerate or delay the timing of the initiation of the defrost cycles. U.S. Pat. No. 4,056,948 shows an arrangement for modifying the accumulation of compressor run time by a humidity controlled switch which operates to extend the time interval between defrost cycles in response to low humidity conditions in the refrigerator. This compensation must be manually selected, however, and does not take in account other factors which have an effect on the need for defrosting.

U.S. Pat. No. 2,781,641 discloses in FIG. 3 a defrost timing control circuit in which the timer is operated conjointly with the simultaneous occurrence of compressor run and door open conditions by means of door sensor and compressor run switches connected in series with the timer motor. Such an arrangement, however, does not allow for the possibility of initiating defrost independent of door opening time as might be required during very low usage periods or while the user is away on vacation. Moreover, there is no provision in this arrangement whereby initiation of the defrost cycle may be delayed from a fixed minimum time interval to a delayed time which is a measure of a fixed amount of actual door opening time. The serial connection of the door sensor and compressor switches requires that both be closed to operate the timer.

SUMMARY OF THE INVENTION

It is, therefore, an object of the invention to provide an improved automatic control of defrost timing in a frost-free refrigerator.

It is another object of the invention to provide automatic control of defrost timing as a function of door opening time and compressor run time in which compressor run time determines the minimum interval between defrost cycles which may be delayed until a fixed amount of door open time is accumulated.

It is a further object of the invention to provide an automatic defrost control operating, in part, as a function of door open time in which a maximum interval between defrost is provided for vacation periods during which few or no door openings occur.

It is a still further object of the invention to provide an alternative form of automatic defrost control of the type described in which the existence of an acceptably cool level in the refrigerator compartments operates as a prerequisite to delayed initiation of a defrost cycle beyond the minimum compressor run time.

These and other objects of the invention are achieved in a self-defrosting refrigerator having at least one food storage compartment with an access door thereto and a refrigerant system including a motor operated compressor, an evaporator for cooling the food storage compartments, thermostatic means for turning the compressor on and off to maintain a desired temperature in the food compartments and defrost heater means for periodically melting frost from the evaporator. In accordance with the invention, there is provided the combination comprising timer operated switch means responsive to the thermostatic means to establish a time interval between defrost cycles which is at least equal to a minimum predetermined amount of compressor run time followed by a defrost cycle time interval of a predetermined maximum duration. The combination of the invention also comprises means for accumulating total compressor run time during the entire elapsed time between defrost cycles, and further includes a door open sensor and means responsive to the door open sensor for accumulating the amount of time the door is open during the interval between defrost cycles at least up to a predetermined amount of door-open time. The combination of the invention still further includes decision means for providing a first control effect representative of the accumulation of a predetermined compressor run time related to the minimum compressor run time of the timer means and a second control effect representative of when the predetermined amount of door-open time is reached. Finally, the combination of the invention includes switch means which is coupled in electrical circuit with the timer means and is effective in response to the decision means to interrupt operation of the timer means in response to the sole presence of the first control effect and to initiate or continue operation of the timer means in response to the simultaneous presence of both the first and second control effects. In this manner, elapsed time between is held to the minimum compressor run time during relatively heavy usage of the refrigerator and is extended to a longer elapsed time during relatively light usage of the refrigerator wherein usage is measured by door-open time.

In a preferred form of the invention, the output of temperature sensors in both the freezer and fresh food sections of the refrigerator compartment are checked when the timer means reaches the minimum compressor run time and, if the compartment temperatures are at normal cold levels indicative of proper functioning without excessive build-up of frost on the evaporator, the timer means is interrupted as described above, assuming the requisite predetermined door-open time has not been reached. On the other hand, if the temperatures are warmer than normal, as would occur with excessive frost build-up, the timer control switch means is operated to continue the timer operation into a defrost cycle even though the predetermined accumulation of door-open time has not been reached. This is of particular value when unusually high ambient humidity conditions impose a heavier burden on the evaporator beyond that assumed in the initial selection of the predetermined door-open time criterion.

DETAILED DESCRIPTION

Figure 1:
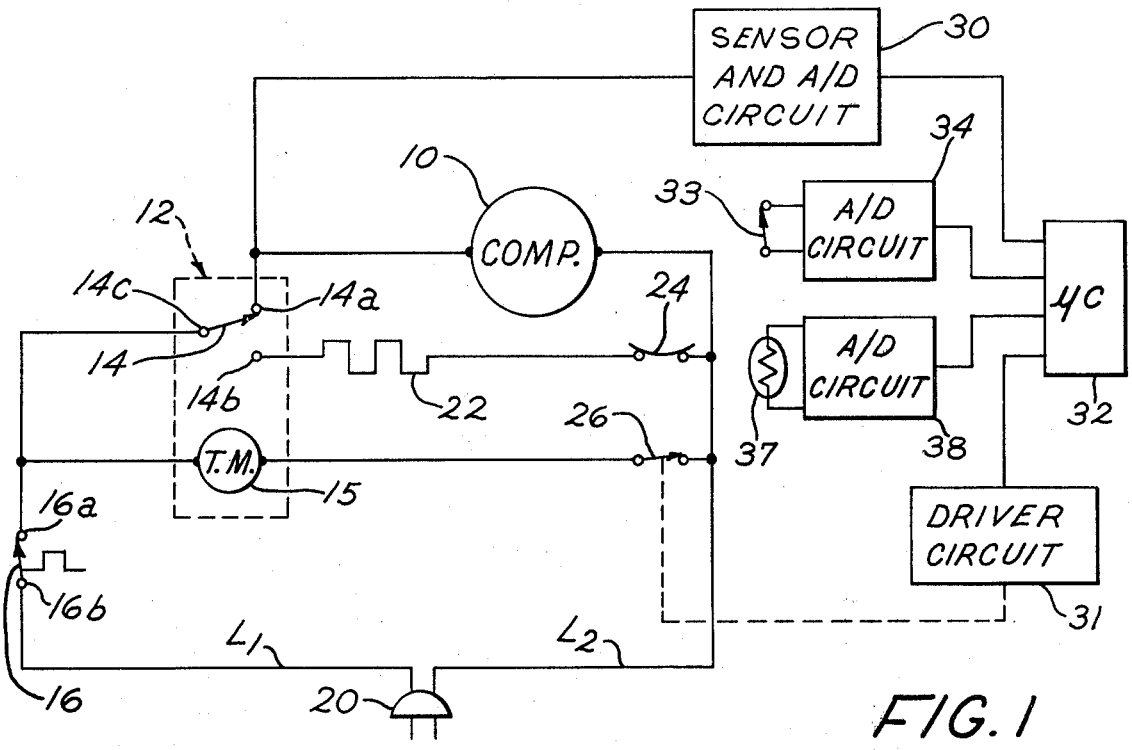
FIG. 1 is a partial circuit of a defrost control system for a frost-free refrigerator constructed in accordance with the invention and employing a microcomputer as the decision means of the invention.

Referring now to FIG. 1, a simplified schematic diagram of a defrost control circuit is shown for a self-defrosting refrigerator in which a motor-compressor unit 10 has one terminal connection to power supply $L_1$ via contact 14*a* of defrost timer switch 14 and thermostatic control switch 16. A second terminal of motor-compressor unit 10 is connected directly to power supply line $L_2$. Power lines $L_1$ and $L_2$ are coupled to a power plug 20 which is adapted to be connected to a conventional 60 hertz, 120 volt household power source. Defrost heater means 22 has one terminal connected to defrost timer switch contact 14*b* and the other terminal connected via a bimetal defrost thermostat 24 to power line $L_2$. At appropriate times in the operation of the self-defrosting circuit of FIG. 1, defrost timer motor 15 advances and moves the arm of switch 14 to bridge contacts 14*b* and 14*c*, thus connecting the one terminal of defrost heater 22 to power line $L_1$ via thermostatic control switch 16 to initiate a defrost cycle. Thermostat 24 is provided, as is well known, to permit the defrost heater 22 to be turned off earlier than allowed by defrost timer 12 once the frost has been removed from the refrigerator evaporator. Thermostat 16 may be of any conventional form such as a vapor-filled bellows-activated device having a pair of contacts 16*a* and 16*b* which close when the temperature in the refrigerator compartment is higher than a desired setting established by the user. Timer motor 15 is connected on one side via a normally closed relay switch 26 to power line $L_2$.

With the exception of the inclusion of switch 26, the foregoing circuit arrangement is conventional in self-defrosting refrigerators. Timer 12 is adapted to provide alternate refrigeration and defrost cycles depending on the positioning of the arm of switch 14 to either contact 14*a* or 14*b*. During the refrigeration cycle, timer motor 15 and its associated cam arrangement (not shown) positions the arm of switch 14 to contact 14*a* thus causing the motor-compressor unit 10 to operate whenever thermostat switch 16 is closed. Thus swtich 16 cycles compressor 10 on and off to maintain a desired temperature level in the refrigerator compartment. Timer motor 15 is also activated at the same time as is compressor 10 in order to establish a minimum compressor run time during the refrigeration cycle as determined by the structure of the cam arrangement of timer 12. This run time may, for example, be on the order of $7\frac{1}{2}$ hours depending on the structure of the timer mechanism, although it will be appreciated that the actual elapsed time between defrost cycles will usually be substantially longer since the cycling of the compressor on and off results in a compressor run time which is only a fraction of the actual elapsed time.

Timer 12 is adapted to provide a fixed maximum time period for the defrost cycle, typically thirty minutes in duration. During this time, the arm of timer switch 14 is set to contact 14*b*. Thermostat switch 16 remains closed since, during defrost, the interior of the refrigerator is slightly warmer than normal. In the event frost is fully melted before the completion of the maximum thirty minute defrost cycle, the evaporator temperature will then rise and thermostatic switch 24 opens to deactivate heater 22, as previously mentioned, in order to avoid unnecessary heat up of the interior refrigerator compartment while timer 12 finishes timing out the remaining portion of the defrost cycle.

In accordance with one aspect of the invention, there is provided means for accumulating total compressor run time during the entire elapsed time that exists between defrost cycles. This includes a sensor circuit 30 connected from timer switch contact 14*a* to one input of microcomputer 32. Sensor circuit 30 may comprise any suitable conversion circuit operative to convert the a-c signal at its input to a digital output signal compatible for input and storage within the memory register of microcomputer 32 thus to accumulate the amount of time which compressor 10 is operated. A door switch 33 is coupled to another input of microcomputer 32 via an analog-to-digital conversion circuit 34 to provide means for accumulating the amount of time the refrigerator door is open. In addition, a temperature sensor 37 located in the interior compartment of the refrigerator has its output coupled through a suitable analog-to-digital conversion circuit 38 to an input of microcomputer 32 to allow periodic sensing and storage of the interior temperature of the refrigerator.

Microcomputer 32 may comprise a self-contained integrated circuit such as a Mostek MK3872 including an arithmetic logic circuit, appropriate memory registers and input/output circuits as is well known in the art. Microcomputer 32, in part, is pre-programmed to be adapted to serve as a decision means for providing a first control effect representative of the accumulation of a predetermined compressor run time related to the minimum run time established by the timer 12 and also to provide a second control effect representative of when a predetermined amount of accumulated door-open time is reached as will be explained subsequently. The predetermined compressor run time which is effective to produce the first control effect may be equal to the minimum compressor run time of timer 12 or it may be less than the minimum run time by a fixed amount.

A timer control switch means 26 is coupled in electrical circuit with timer motor 15 of timer 12 and is operatively controlled by microcomputer 33 via a suitable driver circuit 31 to interrupt the operation of timer motor 15 in response to the sole occurrence of the first control effect and to initiate or continue operation of the timer motor 15 in response to the simultaneous presence of the first and second control effect in microcomputer 32. It will be appreciated that interrupting operating the timer motor 15 during the interval between defrost cycles does not effect the refrigeration operation of the compressor 10 since switch 14 is held with its arm bridging contacts 14*a* and 14*c* such that compressor 10 will continue to be cycled on and off by thermostatic control switch 16. To insure that this is the case, it may be preferred to establish the amount of accumulated run time which produces the first control effect in microcomputer 32 at slightly less than the full amount of minimum compressor run time, as previously mentioned.

Figure 2:
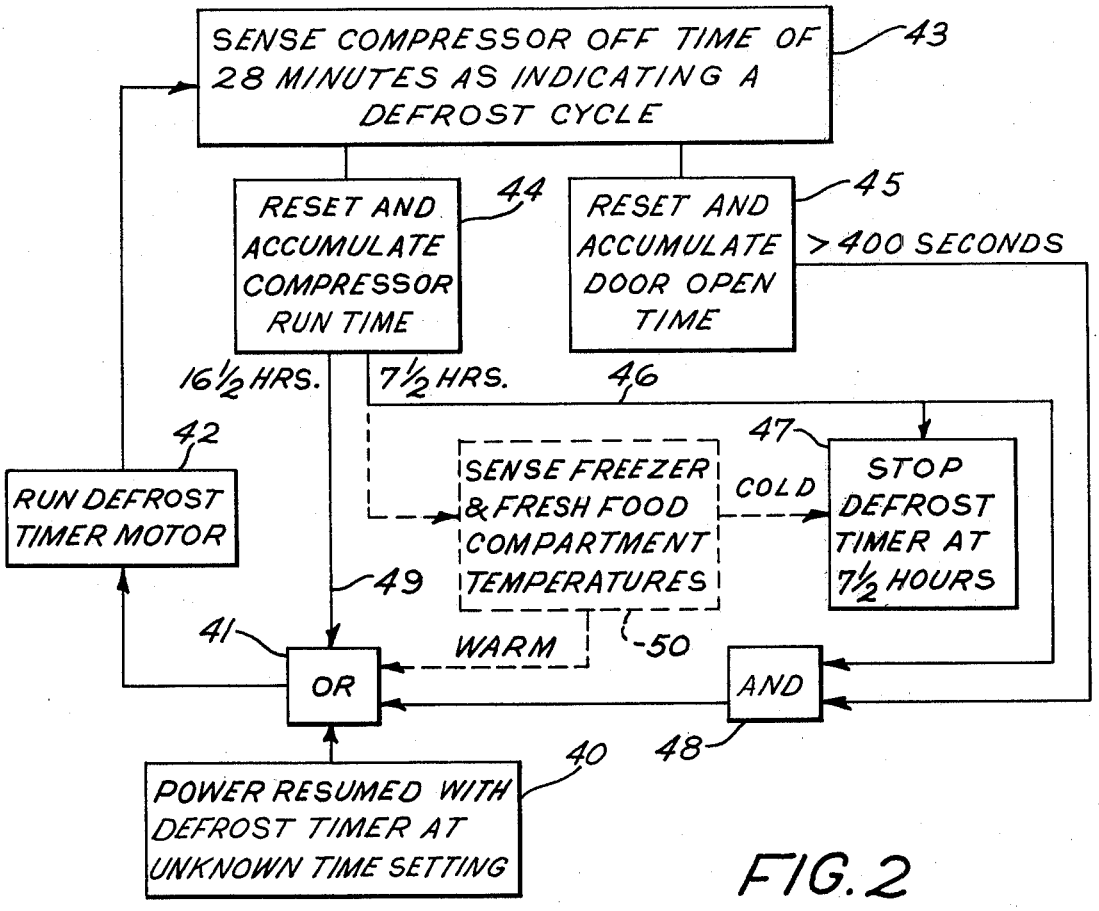
FIG. 2 is a functional block diagram useful in explaining the operation of the circuit of FIG. 1.

Referring now to FIG. 2, the functional operating diagram shown therein illustrates the operation of the FIG. 1 system in extending the time interval between defrost cycles to thereby reduce energy usage during periods of light usage of the refrigerator. Initially, it will be assumed that power is applied to the refrigerator with timer 12 at some unknown setting as indicated in block 40. This initiates the functional instruction applied through OR circuit 41 to block 42 that results in the normal operation of timer motor 15. Since the timer 12 is at an unknown setting, it is necessary to establish a starting point representative of the completion of a defrost cycle from which to begin measuring the accumulated compressor run time and door open time for the purpose of determining the start of the next defrost cycle. It can be shown that, in at least one exemplary form of automatic defrost refrigerator, the time period during which the compressor will remain continuously off does not exceed 25 minutes for a compressor cycling rate of 25% which corresponds to a very warm refrigerator setting or a low room ambient temperature. Thus a time period slightly in excess of this amount such as 28 minutes is selected to indicate the existence of a completed defrost cycle. When this occurs, as sensed in microcomputer 32 via sensor circuit 50 as represented in functional block 43, the mircocomputer will reset the accumulated compressor run time and accumulated door open time memory registers and will begin accumulating run time and door open time starting at time zero as represented in functional blocks 44 and 45. When 7½ hours of accumulated run time is recorded, a functional instruction is sent via line 46 to functional block 47 to interrupt operation of timer motor 15 (corresponding to opening of switch 26 in FIG. 1), and also to functional AND circuit 48. Assuming relatively light usage of the refrigerator such that the amount of door open time has not reached a total of, for example, 400 seconds, the timer motor 15 remains inactive thus forestalling the onset of the next defrost cycle until both inputs to functional AND circuit 48 occur. At this time the output of AND circuit 48 is processed through OR circuit 41 to reactivate timer motor 15 such that the next defrost cycle may be commenced as determined by the operation of timer 12. If, on the other hand, heavy usage of the refrigerator had resulted in an accumulation of the 400 seconds of door open time prior to reaching the 7½ hours of compressor run time, it can be seen that timer motor 15 would not be interrupted and timer 12 would have progressed in normal manner to initiate a defrost cycle at the conclusion of the 7½ hour compressor run time. Thus, it can be seen that with this invention, a simple and effective electronically controlled means is provided whereby elapsed time between defrost cycles is extended beyond a minimum compressor run time during relatively light usage of the refrigerator to reduce energy consumption by the self-defrosting refrigerator.

With the arrangement just described, if the door were not opened for an extended period of time, as during vacation time, a defrost cycle would not be possible even though normal air leakage and heat transfer into the refrigerator might generate sufficient frost on the evaporator coils to require a defrost cycle. For this purpose, a maximum time is provided, for example, 16½ hours, at the conclusion of which a defrost cycle occurs even though the requisite accumulated door open time has not occurred. This is represented by line 49 in FIG. 2.

The dotted portion of FIG. 2 represents an alternative arrangement in which, at the conclusion of the minimum compressor run time of 7½ hours, the interruption of the timer motor that would occur during light usage (accumulated door open time less than 400 seconds) is overridden by the sensing of a warm temperature in the refrigerator compartment which would indicate the existence of heavy frost build-up on the evaporator coils. This might occur, for example, if the room ambient temperature is unusually warm if the relative humidity of the room is unusually high such that frosting of the coils occurs at a faster rate than assumed when selecting the 400 second criteria for the door open time. Thus, if a warm compartment temperature is sensed, the "WARM" input to functional OR block 41 continues operation of the timer motor 15 when the 7½ hour compressor run time is reached and a cold (i.e. normal) temperature permits the timer motor to be interrupted in accordance with the invention.

Figure 3:
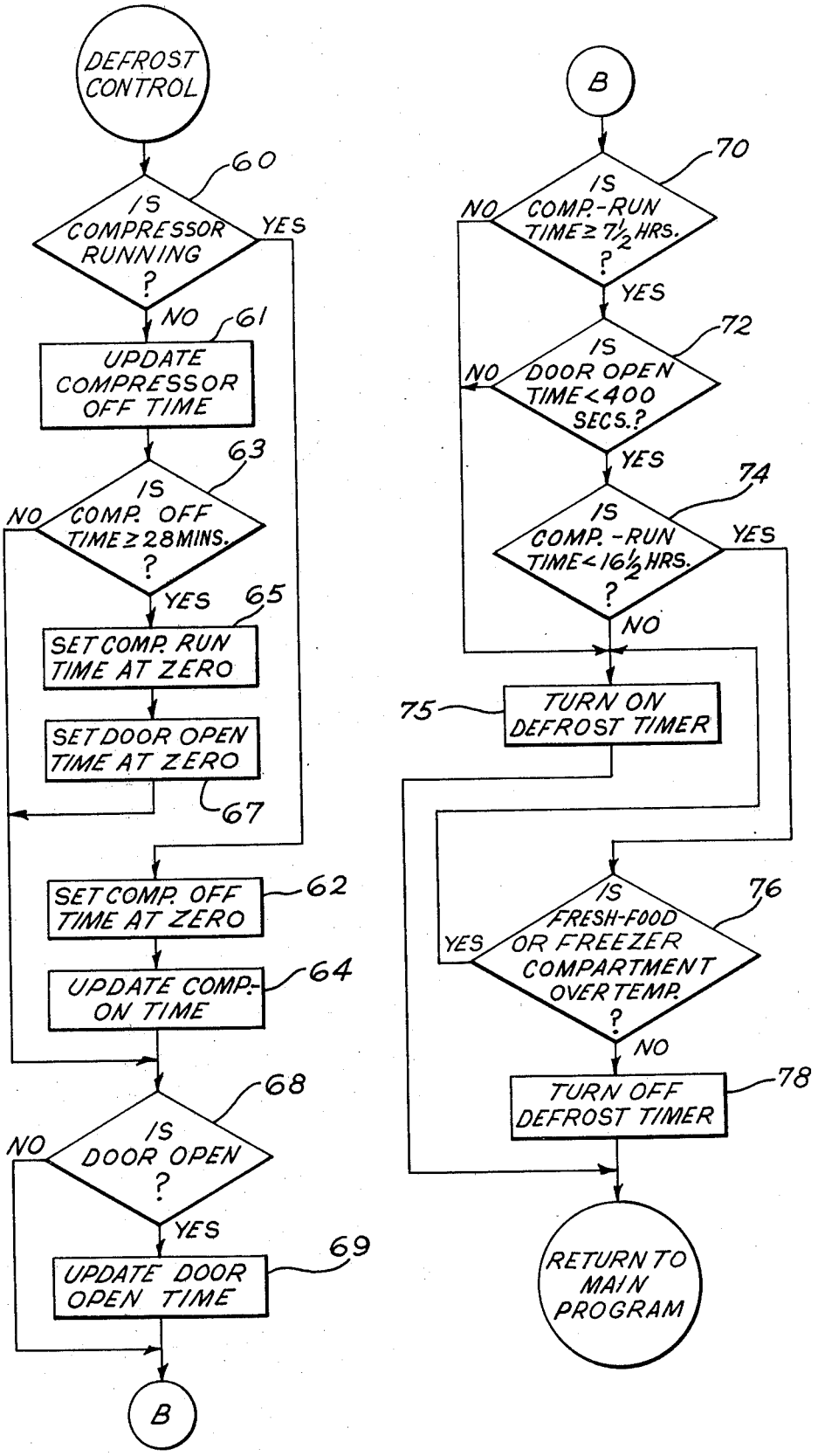
FIG. 3 is a program flow diagram which may be employed in developing a program for the microcomputer of FIG. 1.

Referring now to FIG. 3, a program flow chart is shown which may be used by those skilled in the art to establish a set of program instructions for microcomputer 32. It will be appreciated that the illustrated flow chart may represent only a portion of a complete program for microcomputer 32 by which other functions of the refrigerator are also controlled. Thus, upon entering the defrost control portion of the program, inquiry determines whether the compressor is running and, if so, instructions 62 and 64 reset the compressor off count to zero and update the compressor on count to the next time increment. If the compressor is not running, instruction 61 updates the compressor off count to the next time increment, following which inquiry 63 determines whether the accumulated compressor off time is equal to or greater than 28 minutes. If the answer is yes, indicating the completion of a defrost cycle, instructions 65 and 67 reset the compressor run time and door open time counts to zero in preparation for the timing of the next ensuing interval between the just completed defrost cycle and the next ensuing defrost cycle. If the accumulated compressor off time is less than 28 minutes, or following completion of instructions 64 or 67, the next inquiry 68 of the program determines if the door is open. If so, instruction 69 updates the accumulated door open count. Following this, or if the door was not open, the program moves to instruction 70 to determine if the minimum compressor run time of 7½ hours has been reached. If not, the program moves to instruction 75 to maintain switch 26 closed (FIG. 1), thereby a continue normal operation of timer 12, following which the defrost control program returns for completion of the main program in microcomputer 32.

Assuming, however, that the minimum compressor run time of 7½ hours has been reached, inquiry 72 of the program then determines if the accumulated door open time is less than the minimum predetermined value of, in this example, 400 seconds. An affirmative result indicates that a light usage condition of the refrigerator exists which dictates that the next ensuing defrost cycle should be delayed by interrupting the operation of the timer 12. Before this occurs, however, inquiry 74 determines if the accumulated compressor run time is below the maximum allowable compressor run time of 16½ hours. If not, i.e. 16½ hours has been reached or exceeded, which could be the case during a vacation period, switch 26 is closed to turn on the timer motor 15 so that a defrost cycle can be initiated even though the 400 seconds of door open time had not been reached. On the other hand, if the door open time has not reached 400 seconds and the compressor run time is still below the maximum of 16½ hours, the program could then move to instruction 78 to open switch 26 thus inactivating timer motor 15. In the example shown in FIG. 3, however, provision is made in inquiry 76 for first determining the status of the temperature in the refrigerator compartment. If a normal temperature is sensed, the program moves to instruction 78 to stop timer motor 15 since the normal temperature indicates no abnormal build-up of frost on the evaporator coils. Conversely, a sensed warm temperature causes the program to revert to instruction 75 to hold closed or re-close, as appropriate, switch 26 so that timer 12 can move on and initiate a defrost cycle. Following initiation of the appropriate instruction, the defrost control program then returns to the main program.

It will be appreciated that there has been described a simple and effective electronic defrost control for an automatic defrost refrigerator whereby energy usage may be minimized by delaying initiation of the defrost cycle beyond the normal minimum compressor run time during periods of light usage as measured by accumulated door open time. An alternative arrangement has also been shown which operates to override the door open measurement when interior temperature measurement indicates abnormal frost build-up that requires an early initiation defrost cycle even though the door open measurement indicates light usage of the refrigerator.

What is claimed is:

1. In a self-defrosting refrigerator having at least one food storage compartment with an access door thereto and a refrigerant system including a motor-operated compressor, an evaporator for cooling the food storage compartments, thermostatic means for turning the compressor on and off to maintain a desired temperature in the food compartments, and defrost heater means for periodically removing frost build-up from the evaporator, the combination comprising:

timer operated switch means responsive to the thermostatic means (a) during the compressor-on periods to establish a minimum compressor run time between defrost cycles and (b) during the defrost cycle to activate the defrost heater means for a predetermined maximum defrost period;

means for accumulating total compressor run time during the entire elapsed time between defrost cycles;

a door open sensor;

means responsive to the door open sensor for accumulating the amount of time the door is open at least up to a predetermined amount of door-open time;

decision means for providing a first control effect representative of when the accumulation of compressor run time reaches the minimum run time of the timer means and a second control effect representative of when the predetermined amount of accumulated door-open time is reached;

and timer control switch means coupled in electrical circuit with the timer means and effective in response to the decision means to interrupt operation of the timer means in response to the sole presence of the first control effect, and to initiate or continue operation of the timer means in response to the simultaneous presence of both the first and second control effects;

whereby elapsed time between defrost cycles is extended beyond a minimum compressor run time during relatively light usage of the refrigerator wherein usage is measured by door open time.

2. The combination of claim 1 including means for sensing interior compartment temperature, the decision means being operative in response to a higher than normal compartment temperature after reaching the minimum compressor run time to provide a third control effect operative to initiate or continue operation of the timer means even in the absence of the second control effect representative of having reached the minimum predetermined accumulated door open time.

3. The combination of claim 1 in which the minimum predetermined accumulated door open time is approximately 400 seconds.

* * * * *